US009870014B1

(12) United States Patent
Ham et al.

(10) Patent No.: US 9,870,014 B1
(45) Date of Patent: Jan. 16, 2018

(54) DIGITAL LOW DROP-OUT REGULATOR

(71) Applicants: SK hynix Inc., Gyeonggi-do (KR); THE TRUSTEES OF COLUMBIA UNIVERSITY IN THE CITY OF NEW YORK, New York, NY (US)

(72) Inventors: Hyun-Ju Ham, Gyeonggi-do (KR); Jong-Hwan Kim, Gyeonggi-do (KR); Min-Goo Seok, Tenafly, NJ (US); Do-Yun Kim, New York, NY (US)

(73) Assignees: SK Hynix Inc., Gyeonggi-do (KR); THE TRUSTEES OF COLUMBIA UNIVERSITY IN THE CITY OF NEW YORK, New York, NY (US)

( * ) Notice: Subject to any disclaimer, the term of this patent is extended or adjusted under 35 U.S.C. 154(b) by 0 days.

(21) Appl. No.: 15/423,690

(22) Filed: Feb. 3, 2017

(51) Int. Cl.
*G05F 1/625* (2006.01)

(52) U.S. Cl.
CPC ..... *G05F 1/625* (2013.01)

(58) Field of Classification Search
CPC . G05F 1/56; G05F 1/563; G05F 1/565; G05F 1/575; G05F 1/595; G05F 1/625; H02M 3/156–3/158; H02M 3/1588; H02M 2001/0032; H02M 2001/0045; Y02B 70/1466
USPC ..... 323/265, 268, 269, 271, 275
See application file for complete search history.

(56) References Cited

U.S. PATENT DOCUMENTS 3,341,776 A * 9/1967 Doelz ..... H04L 5/12 375/261
3,440,617 A * 4/1969 Lesti ..... G06K 9/00 382/224
3,493,874 A * 2/1970 Janes ..... G01S 7/2922 327/552
7,102,403 B2 * 9/2006 Wang ..... H03L 7/07 327/158
7,675,345 B2 * 3/2010 Fayed ..... H03K 3/012 326/62
8,981,743 B2 * 3/2015 Zambetti ..... H02M 3/1584 323/272
2014/0266103 A1 9/2014 Wang et al.
2017/0126050 A1 * 5/2017 Zhang ..... H02J 7/04

FOREIGN PATENT DOCUMENTS

KR 101621367 6/2016

* cited by examiner

*Primary Examiner* — Yemane Mehari
(74) *Attorney, Agent, or Firm* — IP & T Group LLP

(57) ABSTRACT

A regulator may comprise: an ADC unit for detecting a change in an output voltage and outputting an error code based on the detected result; a digital processing unit for generating a proportional control signal, a plurality of integral control signals, a counting signal, and an error sign signal based on the error code, outputting pull-up and pull-down control signals by multiplying the error code by a proportional gain factor in response to the proportional control signal, and outputting a plurality of sub-pull-up control signals by performing integration on the integral control signals based on the counting signal and multiplying the integration result by an integral gain factor; a first driving unit for outputting a first current in response to the pull-up and pull-down control signals; and a second driving unit for outputting a second current in response to the sub-pull-up control signals.

21 Claims, 10 Drawing Sheets

DIGITAL LOW DROP-OUT REGULATOR

BACKGROUND

1. Field

Exemplary embodiments of the present invention relate to a semiconductor designing technology, and more particularly, to a digital low drop-out (LDO) regulator.

2. Description of the Related Art

Recent efforts to develop more diversified and miniaturized electronic devices include mounting diverse circuits on a single chip. Such a system is often referred to as a system on a chip (SOC). For example, various analog, digital, radio frequency (RF) circuits may be integrated into a single chip. As various circuits are integrated into one chip, an efficient and stable power source voltage management system is required.

A low drop-out (LDO) regulator is one of the essential elements in a power source voltage management system. The LDO regulator may be used to stably supply a power source voltage to the circuits. To this end, the LDO regulator may be used along with a switching regulator. The LDO regulator may be mainly used to supply the power source voltage to circuits, such as an analog-to-digital converter (ADC) and a voltage-controlled oscillator (VCO), that have a small number of external circuits, have simple structures, and have characteristics sensitive to a supplied voltage without ripple occurring inside.

Meanwhile, an analog LDO regulator may not decrease a power source voltage because the analog LDO regulator uses an amplifier, and the analog LDO regulator has to set a great bandwidth to perform a high-speed operation, which is difficult for the analog LDO regulator. Conversely, since a digital LDO regulator does not use an amplifier, the digital LDO regulator may be able to decrease the power source voltage greatly. Also, since the digital LDO regulator has a bandwidth that is approximate to infinity, the digital LDO regulator may easily perform a high-speed operation.

Therefore, researchers and the industry are briskly studying to further develop the digital LDO regulator.

SUMMARY

Embodiments of the present invention are directed to an event-driven, digital low drop-out (LDO) regulator that has a short control loop latency while maintaining low power consumption.

In accordance with an embodiment of the present invention, a regulator may include: an analog-to-digital converting unit suitable for detecting a change in an output voltage from an output node and outputting an error code based on the detected result; a digital processing unit suitable for generating a proportional control signal, a plurality of integral control signals, a counting signal, and an error sign signal based on the error code, outputting pull-up and pull-down control signals by multiplying the error code by a proportional gain factor in response to the proportional control signal, and outputting a plurality of sub-pull-up control signals by performing integration on the integral control signals based on the counting signal and multiplying the integration result by an integral gain factor; a first driving unit suitable for outputting a first current in response to the pull-up and pull-down control signals to the output node; and a second driving unit suitable for outputting a second current in response to the sub-pull-up control signals to the output node.

In accordance with another embodiment of the present invention, a regulator may include: an analog-to-digital converting unit suitable for detecting a change in an output voltage from an output node and outputting an error code based on the detected result; a control signal generation unit suitable for generating a proportional control signal, a plurality of integral control signals, and a counting signal, and an error sign signal based on the error code; a proportional control unit suitable for shifting the error code based on a proportional gain factor, and outputting a first control signal by synchronizing the shifted error code with the proportional control signal; a first driving unit suitable for outputting a first current in response to the first control signal to the output node; an integral control unit suitable for shifting the integral control signals based on the counting signal and an integral gain factor at least two times, and outputting shifted results as a plurality of second control signals based on the error sign signal; and a second driving unit suitable for outputting a second current in response to the second control signals to the output node.

DETAILED DESCRIPTION

Figure 1:
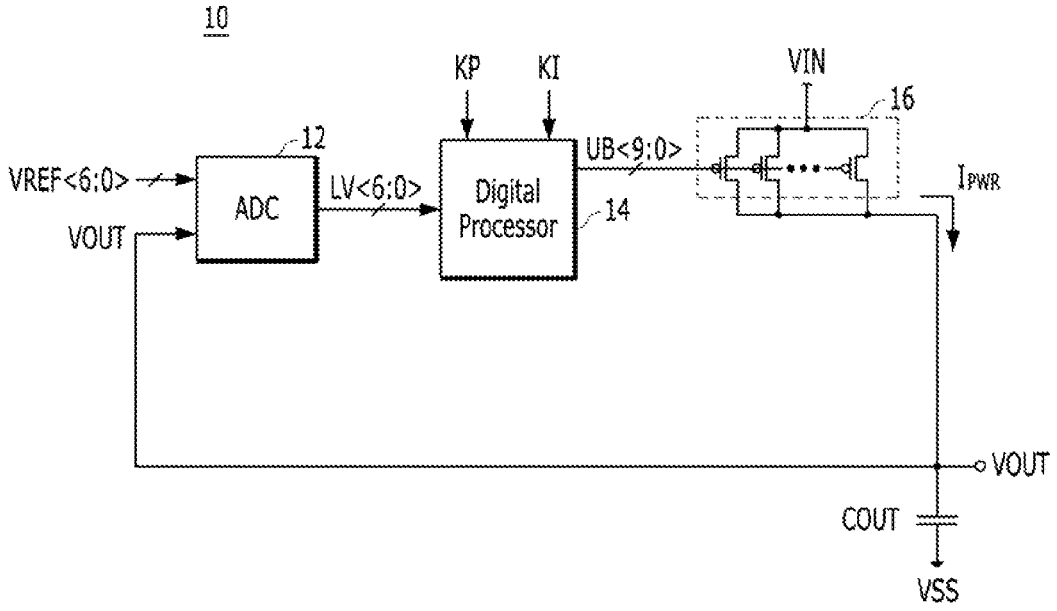
FIG. 1 is a block diagram illustrating an event-driven digital low drop-out (LDO) regulator.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

When a loaded current is drastically raised and an output voltage drops, an analog low drop-out (LDO) regulator may feed it back and realizes a loop control through an error amplifier. Such analog LDO regulator may excessively consume stand-by power and deteriorate stability due to the presence of the amplifier in the feed-back. Also, since an off-chip output capacitor whose size is equal to or greater than a predetermined size has to be used for frequency compensation, the circuit may become bigger and the circuit may be sensitive to external noise.

To solve these deficiencies, research is being briskly carried out to develop a digital LDO regulator capable of decreasing the size of an output capacitor or to develop a cap-less LDO regulator that does not include an output capacitor at all.

To remove the output capacitor or reduce the size of the output capacitor, the control loop latency has to be shortened. An analog LDO regulator provided with a high-speed amplifier or a synchronous time-driven digital LDO regulator having a high sampling frequency could therefore be used, however, such regulators are also problematic because they require increased power consumption. The present invention provides an event-driven digital LDO regulator that defies the correlation relationship between power efficiency and control loop latency of conventional digital LDO regulators. The event-driven digital LDO regulator of the present invention is capable of both a short control loop latency and a low power consumption.

FIG. 1 is a block diagram illustrating an event-driven digital LDO regulator 10.

Referring to FIG. 1, the digital LDO regulator 10 may include an analog-to-digital converter (ADC) 12, a digital processor 14, and a power transistor array 16.

The analog-to-digital converter 12 may be fed back with an output voltage VOUT, which is an analog value, may detect an error component, and may output an error code LV<6:0>, which is a digital value. The analog-to-digital converter 12 may compare the output voltage VOUT with a reference voltage code VREF<6:0>, and output the error code LV<6:0> based on the comparison result.

The digital processor 14 may be realized as a proportional-integral (PI) controller. For example, the digital processor 14 may include a proportional part (not shown) in charge of fast regulation in the initial state of voltage variation and an integral part (not shown) in charge of removing an error in a steady state. When the error code LV<6:0> is inputted, the proportional and the integral parts of the digital processor 14 may digitally process the error code LV<6:0> by using proportional and integral gain factors KP and KI, respectively, and generate a control signal UB<9:0>.

The power transistor array 16 may include a plurality of transistors (e.g., PMOS transistors) that are coupled in parallel between an input voltage terminal VIN and an output voltage terminal VOUT. The power transistor array 16 may control the output voltage VOUT by controlling the number of transistors that are turned on/off based on the control signal UB<9:0> which may be applied on the respective gate of one or more of the transistors. Then, the output voltage VOUT may be supplied to an external capacitor COUT.

As described above, the event-driven digital LDO regulator 10 may regard a change in the error code LV<6:0> as the occurrence of an event and generate the control signal UB<9:0>, and maintain the output voltage VOUT at a predetermined voltage level by controlling the number of transistors that are turned on/off in the power transistor array 16 based on the generated control signal UB<9:0>.

Figure 2:
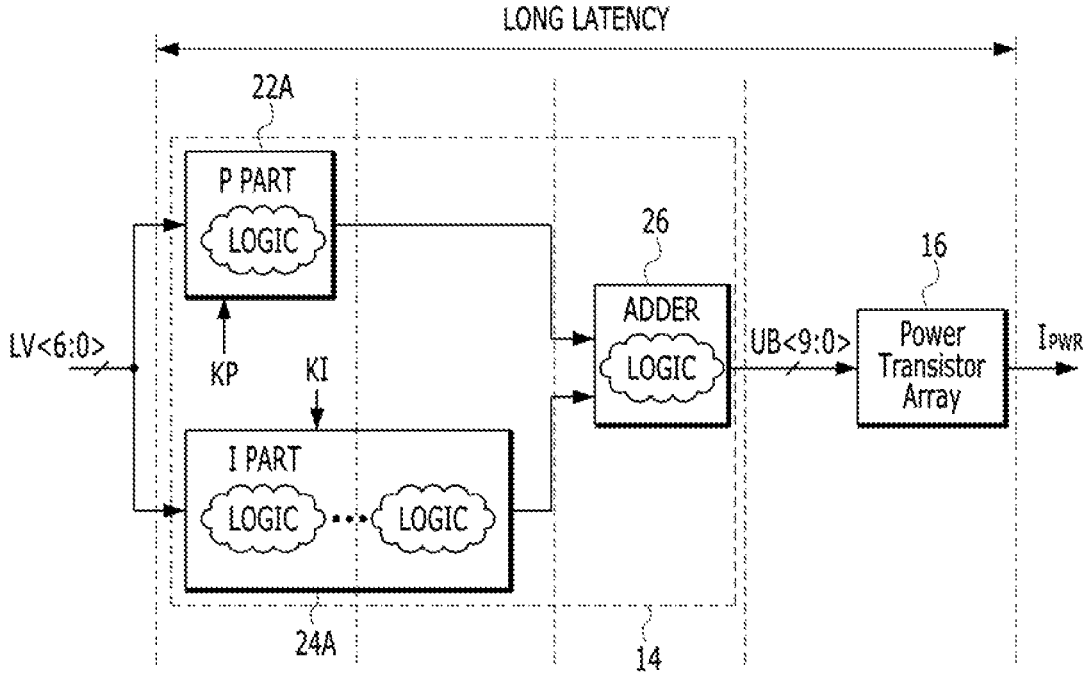
FIG. 2 is a block diagram illustrating a scheme of the digital LDO regulator shown in FIG. 1.

FIG. 2 is a block diagram illustrating a scheme of the digital LDO regulator 10 shown in FIG. 1.

Referring to FIG. 2, the digital processor 14 of the digital LDO regulator 10 may include a proportional (P) part 22A, an integral (I) part 24A, and an adder 26.

The proportional part 22A may output a process result obtained by multiplying the error code LV<6:0> by the proportional gain factor KP. The integral part 24A may output a process result obtained by performing integration on the error code LV<6:0> and multiplying the integration result by the integral gain factor KI. The adder 26 may add the process result of the proportional part 22A to the process result of the integral part 24A and output the control signal UB<9:0> to power transistor array 16.

With the digital processor 14 of FIG. 2, the addition result (which is the control signal UB<9:0>) may be obtained by the adder 26 and may be inputted into the power transistor array 16 only after both the proportional part 22A and the integral part 24A have gone through their respective digital processing individually. The proportional part 22A has a shorter latency than the integral part 24A which has a more complex logic structure. Hence, although digital processing may be finished in the proportional part 22A, digital processing may be still being performed in the integral part 24A. Therefore, the process result of the proportional part 22A may have to wait in the adder 26. Since the power transistor array 16 may be able to be controlled only after the adder 26 performs an addition operation onto the process results obtained by the digital processing of the proportional part 22A and the integral part 24A, the digital LDO regulator 10 shown in FIG. 2 may be able to have a long control loop latency dictated by the longer latency of the integral part 24A.

Figure 3:
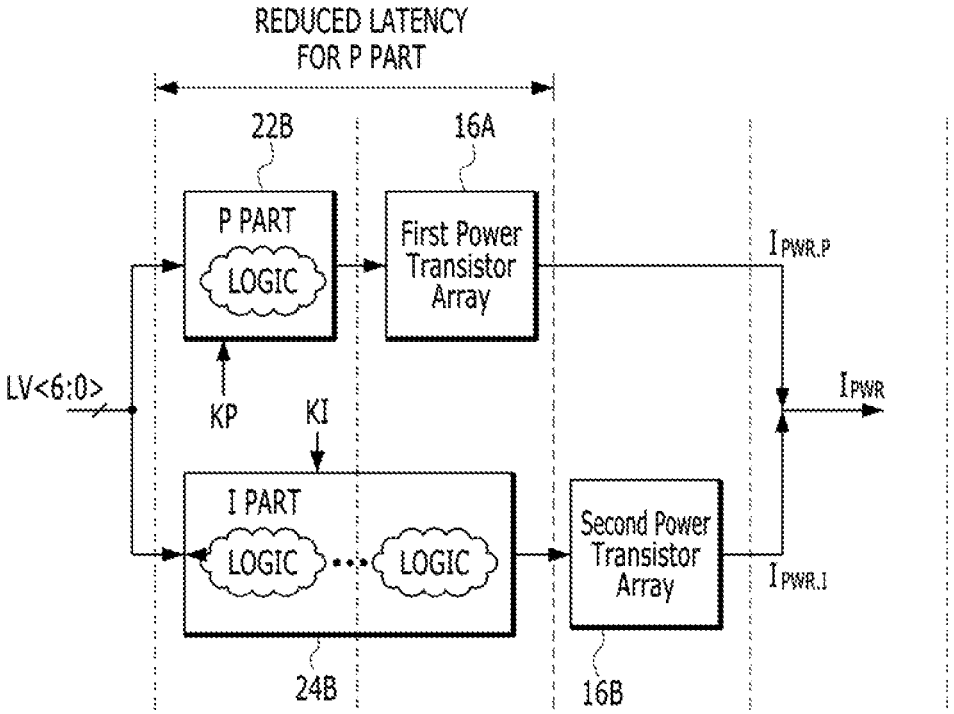
FIG. 3 is a block diagram illustrating a scheme of a digital LDO regulator in accordance with an embodiment of the present invention.

FIG. 3 is a block diagram illustrating a scheme of an event-driven digital LDO regulator in accordance with an embodiment of the present invention.

Referring to FIG. 3, in an embodiment of the present invention, a proportional (P) part 22B and an integral (I) part 24B of a digital LDO regulator are realized in a parallel scheme by removing the adder 26 shown in FIG. 2 and separately including a first power transistor array 16A for the proportional part 22B and a second power transistor array 16B for the integral part 24B. For example, the control loop latency of the digital LDO regulator may be decreased and the regulation performance may be improved by adding a result of controlling the first power transistor array 16A based on the process result of the proportional part 22B as a current type (i.e., $I_{PWR.P}$) and a result of controlling the second power transistor array 16B based on a process result of the integral part 24B as a current type (i.e., $I_{PWR.I}$) in a current domain. In particular, it may be seen in FIG. 3 that the control loop latency of the proportional part 22B is drastically decreased. Therefore, the proportional part 22B may take charge of fast regulation in the initial state.

Hereafter, the embodiments of the present invention will be described specifically by referring to the accompanying drawings.

Figure 4:
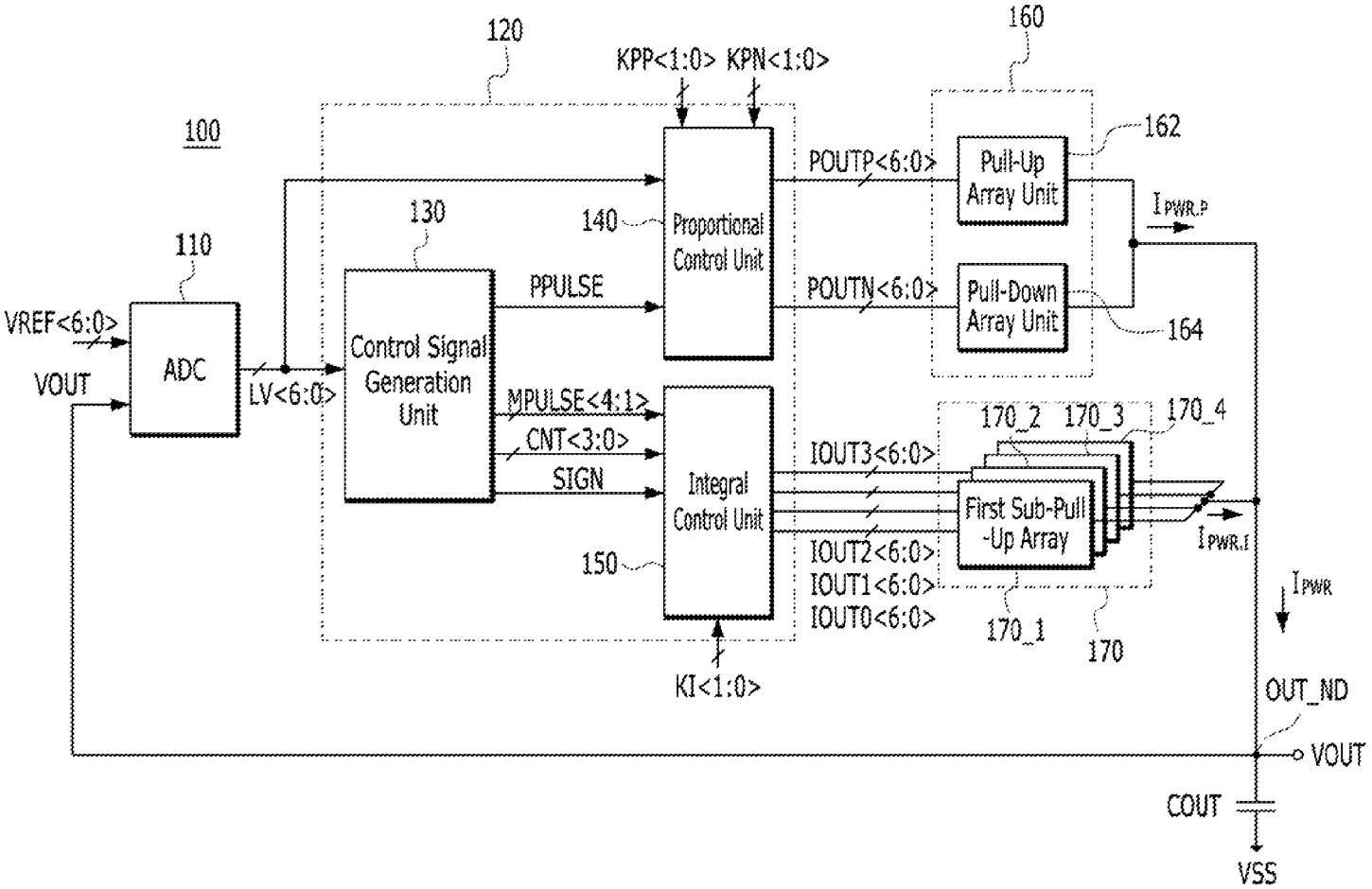
FIG. 4 is a block diagram illustrating a digital LDO regulator in accordance with an embodiment of the present invention.
Figure 5A:
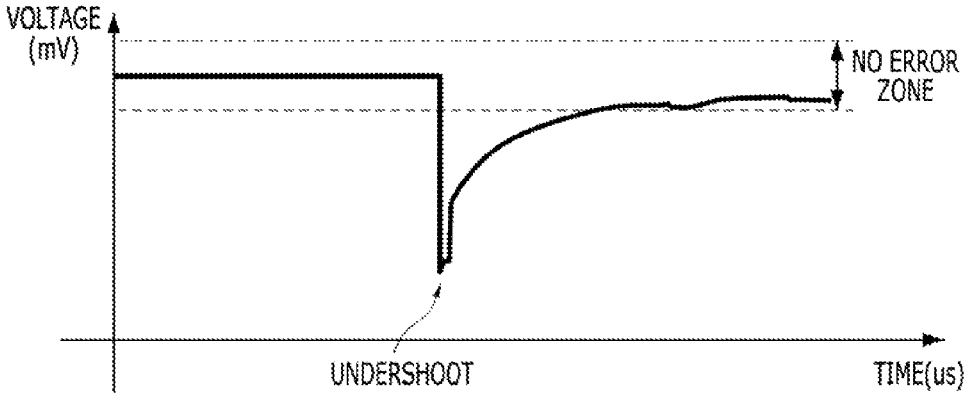
FIGS. 5A and 5B are waveform diagrams illustrating an undershoot and an overshoot of an output voltage, respectively.
Figure 5B:
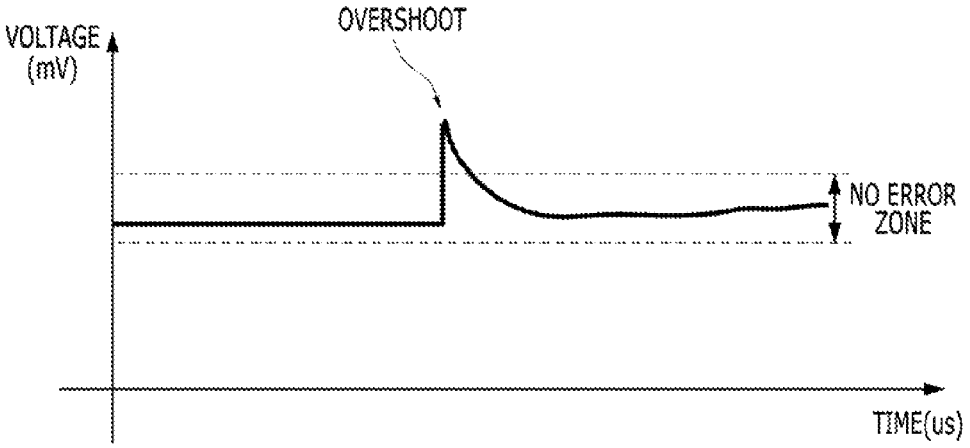

FIG. 4 is a block diagram illustrating a digital LDO regulator 100 in accordance with an embodiment of the present invention. FIGS. 5A and 5B are waveform diagrams illustrating undershoot and overshoot of an output voltage, respectively.

Referring to FIG. 4, the digital LDO regulator 100 may include an analog-to-digital converter (ADC) 110, a digital processor 120, a first array driver 160, and a second array driver 170.

The analog-to-digital converter 110 may detect an error component out of an analog output voltage VOUT that is outputted from an output node OUT_ND, and output a digital error code LV<6:0>. The analog-to-digital converter 110 may asynchronously compare the output voltage VOUT with a reference voltage code VREF<6:0>. Also, based on the comparison result, the analog-to-digital converter 110 may detect a change such as an overshoot or an undershoot of the output voltage VOUT as an error component, and output a multi-bit error code LV<6:0> based on the detected change. Herein, the error code LV<6:0> may be formed of a unary code such as, for example, a thermometer code. For example, when the analog-to-digital converter 110 outputs a 7-bit error code LV<6:0>, the number of ones ('1') of the error code LV<6:0> may be decided based on the overshoot or undershoot of the output voltage VOUT shown in TABLE 1. Hereafter, it is assumed that when the output voltage VOUT reaches an ideal target voltage level and there is no substantial change, the analog-to-digital converter 110 may output an error code LV<6:0> with '0001111'.

TABLE 1

| Change in Output Voltage VOUT | Error Code LV<6:0> |
|---|---|
| Undershoot | 0000001 |
| Undershoot | 0000011 |
| Undershoot | 0000111 |
| No Error | 0001111 |
| Overshoot | 0011111 |
| Overshoot | 0111111 |
| Overshoot | 1111111 |

The digital processor 120 may calculate the magnitude of the error code LV<6:0> and calculate a sign for the error code LV<6:0> to generate control signals, such as a proportional control signal P_PULSE, a plurality of integral control signals MPULSE<4:1>, a counting signal CNT<3:0>, and an error sign signal SIGN. Also, the digital processor 120 may output multiplication results obtained by multiplying the error code LV<6:0> by first and second proportional gain factors KPN<1:0> and KPP<1:0> based on the proportional control signal PPULSE as a pull-up control signal POUTP<6:0> and a pull-down control signal POUTN<6:0>. Further, the digital processor 120 may perform an integral operation on the plurality of integral control signals MPULSE<4:1> based on the counting signal CNT<3:0>, and output a multiplication result obtained by multiplying the integration operation result by an integral gain factor KI<1:0> as a plurality of sub-pull-up control signals IOUT0<6:0> to IOUT3<6:0>.

The digital processor 120 may include a control signal generation unit 130, a proportional control unit 140, and an integral control unit 150.

The control signal generation unit 130 may generate the proportional control signal PPULSE, the integral control signals MPULSE<4:1>, the counting signal CNT<3:0>, and the error sign signal SIGN based on the error code LV<6:0>. When the error code LV<6:0> is changed, the control signal generation unit 130 may determine that an event has occurred, and calculate the magnitude of the error code LV<6:0> and a sign for the error code LV<6:0> individually. Whenever the error code LV<6:0> is changed, the control signal generation unit 130 may enable the proportional control signal PPULSE and enable one signal corresponding to the magnitude of the change of the error code LV<6:0> among second to fifth integral control signals MPULSE<4:1>. The control signal generation unit 130 may output the information indicating whether the change of the error code LV<6:0> is an overshoot or an undershoot as the error sign signal SIGN. For example, when the error code LV<6:0> is an overshoot or 'no error' the control signal generation unit 130 may output the error sign signal SIGN with a logic high level. Conversely, when the error code LV<6:0> is undershoot, the control signal generation unit 130 may output the error sign signal SIGN with a logic low level. Also, the control signal generation unit 130 may output the counting signal CNT<3:0> at a uniform cycle to provide time information.

The proportional control unit 140 may synchronize the multiplication results obtained by multiplying the error code LV<6:0> by the first and second proportional gain factors KPN<1:0> and KPP<1:0> with the proportional control signal PPULSE, individually, and output the pull-up control signal POUTP<6:0> and the pull-down control signal POUTN<6:0>. According to the embodiment of the present invention, the proportional control unit 140 may shift a first bit group of the error code LV<6:0> according to the first proportional gain factor KPN<1:0>, and output the shifting result as the pull-up control signal POUTP<6:0> according to the proportional control signal PPULSE. Also, the proportional control unit 140 may shift a second bit group of the error code LV<6:0> according to a second proportional gain factor KPP<1:0>, and output the shifting result as the pull-down control signal POUTN<6:0> according to the proportional control signal PPULSE. Herein, the first bit group may include a lower bit group (which includes first to fourth bits LV<3:0>) of the error code LV<6:0>, and the second bit group may include an upper bit group (which includes fifth to seventh bits LV<6:4>) of the error code LV<6:0>. Therefore, the proportional control unit 140 may generate the pull-up control signal POUTP<6:0> based on information indicating the undershoot of the output voltage VOUT, and generate the pull-down control signal POUTN<6:0> based on information indicating the overshoot of the output voltage VOUT.

The first array driver 160 may control the driving force of a first current $I_{PWR.P}$ and output it to the output node OUT_ND in response to the pull-up control signal POUTP<6:0> and the pull-down control signal POUTN<6:0>.

The first array driver 160 may include a pull-up array unit 162 for compensating for an undershoot of the output voltage VOUT and a pull-down array unit 164 for compensating for an overshoot of the output voltage VOUT.

The pull-up array unit 162 may include a plurality of pull-up transistors (not shown) that are coupled in parallel between a power source voltage terminal and the output node OUT_ND, and control the number of pull-up transistors that are turned on in response to the pull-up control signal POUTP<6:0>. The pull-down array unit 164 may include a plurality of pull-down transistors (not shown) that are coupled in parallel between the output node OUT_ND and a ground voltage terminal, and control the number of pull-down transistors that are turned on in response to the pull-down control signal POUTN<6:0>.

The integral control unit 150 may shift the second to fifth integral control signals MPULSE<4:1> at least two times based on the integral gain factor KI<1:0> and the counting signal CNT<3:0>, and output the shifting result as the first to fourth sub-pull-up control signals IOUT0<6:0> to IOUT3<6:0> based on the error sign signal SIGN. The integral control unit 150 may primarily shift the second to fifth integral control signals MPULSE<4:1> based on the counting signal CNT<3:0> which informs time information, and secondarily shift the shifted signal based on the integral gain factor KI<1:0>. Also, the integral control unit 150 may finally control a pre-stored code value based on the shifting result and the error sign signal SIGN and output the first to fourth sub-pull-up control signals IOUT0<6:0> to IOUT3<6:0>.

The second array driver 170 may control the driving force of the second current $I_{PWR.I}$ and output the controlled driving force to the output node OUT_ND in response to the first to fourth sub-pull-up control signals IOUT0<6:0> to IOUT3<6:0>.

The second array driver 170 may include a plurality of sub-pull-up array units 170_1 to 170_4. The number of the sub-pull-up array units 170_1 to 170_4 may respectively correspond to the sub-pull-up control signals IOUT0<6:0> to IOUT3<6:0> in one to one correspondence. For example, the second array driver 170 may include the first to fourth sub-pull-up array units 170_1 to 170_4 corresponding to the first to fourth sub-pull-up control signals IOUT0<6:0> to IOUT3<6:0>. Each of the first to fourth sub-pull-up array units 170_1 to 170_4 may include a plurality of pull-up transistors (not shown) that are coupled in parallel between the power source voltage terminal and the output node OUT_ND, and control the number of pull-up transistors that are turned on in response to an assigned signal among the first to fourth sub-pull-up control signals IOUT0<6:0> to IOUT3<6:0>. Finally, the output voltage VOUT may be supplied to an external capacitor COUT.

Referring to FIG. 5A, when undershoot occurs, i.e., the detected voltage error is less than a target no-error zone the proportional control unit 140 of FIG. 4 may mainly take charge of fast to regulation in the initial state of the voltage drop, whereas the integral control unit 150 may mainly take charge of removing an error in a steady state following the initial state. Likewise, referring to FIG. SB, when overshoot occurs in the no-error zone the proportional control unit 140 of FIG. 4 may mainly take charge of fast regulation in the initial state of voltage raise, and the integral control unit 150 may mainly take charge of removing an error in the steady state following the initial state. The no error range may be defined as a state where there is no substantial change in the detected output voltage VOUT.

In the event-driven digital LDO regulator 100 in accordance with an embodiment of the present invention, the proportional control unit 140 and the integral control unit 150 are realized in a parallel scheme and the adder of FIG. 2 is removed. The event-driven digital LDO regulator 100 of FIG. 4 further includes separate first and second array drivers 160 and 170 for proportional control and integral control respectively. For example, when a voltage drop as the one illustrated in FIG. 5A occurs or a voltage raise as the one illustrated in FIG. 58 occurs, regulation performance may be improved, in the form of current in a current domain, by adding first and second currents $I_{PWR.P}$ and $I_{PWR.I}$ and reducing the control loop latency of the proportional control unit 140. The first current $I_{PWR.P}$ is obtained by controlling the first array driver 160 based on the pull-up control signal POUTP<6:0> and the pull-down control signal POUTN<6:0> that are outputted from the proportional control unit 140. The second current $I_{PWR.I}$ is obtained by controlling the second array driver 170 based on the sub-pull-up control signals IOUT0<6:0> to IOUT3<6:0> that are outputted from the integral control unit 150. The event-driven digital LDO regulator 100 is capable of compensating both an undershoot and an overshoot of the output voltage VOUT by including both of the pull-up array unit 162 for compensating for an undershoot of the output voltage VOUT and the pull-down array unit 164 for an overshoot of the output voltage VOUT.

Figure 6:
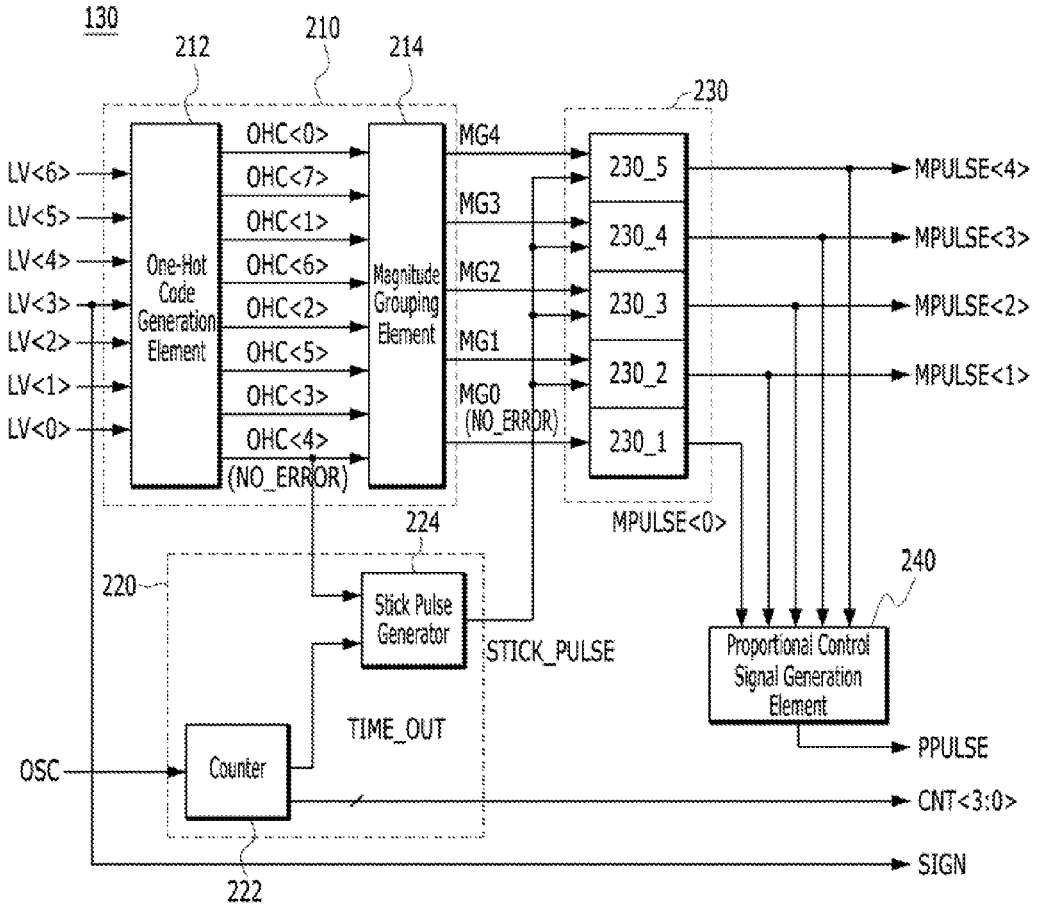
FIG. 6 is a block diagram illustrating an exemplary structure of a control signal generation unit shown in FIG. 4.

FIG. 6 is a block diagram illustrating an exemplary structure of the control signal generation unit 130 shown in FIG. 4.

Referring to FIG. 6, the control signal generation unit 130 may include an error calculation element 210, a counting element 220, an integral control signal generation element 230, and a proportional control signal generation element 240.

The error calculation element 210 may receive the 7-bit error code LV<6:0> and perform a magnitude calculation for the 7-bit error code LV<6:0> to generate first to fifth magnitude signals MG0 to MG4. Also, the error calculation element 210 may output the information indicating whether the change of the 7-bit error code LV<6:0> is an overshoot or an undershoot as the error sign signal SIGN. For example, the error calculation element 210 may output the middle bit, which is the fourth bit LV<3>, of the error code LV<6:0> as the error sign signal SIGN.

The error calculation element 210 may include an one-hot code generation element 212 and a magnitude grouping element 214.

The one-hot code generation element 212 may receive the 7-bit error code LV<6:0> and generate an 8-bit one-hot code OHC<7:0> by scanning the 7-bit error code LV<6:0> from the least significant bit (LSB) of the error code LV<6:0> toward the most significant bit (MSB) and detecting an inflection point where the logic level is changed. In an embodiment, the error code LV<6:0> is formed using a thermometer code, which is a unary code, the error code LV<6:0> may have an inflection point where the logic level is changed from a logic high level to a logic low level as it goes from the LSB to the MSB. The one-hot code generation element 212 may enable a bit corresponding to the inflection point among the 8-bit one-hot code OHC<7:0>.

For example, when the error code LV<6:0> is '0001111', there is an inflection point between the fourth bit LV<3> and the fifth bit LV<4> of the error code LV<6:0>. Therefore, the one-hot code generation element 212 may generate the one-hot code OHC<7:0> where the fifth bit LV<4> is enabled, For example, the one-hot code OHC<7:0> of '00010000'. Herein, the fifth bit LV<4> of the one-hot code OHC<7:0> may be outputted as a no-error signal NO_ERROR which indicates that there is no change in the output voltage VOUT. In short, when the error code LV<6:0> has a value corresponding to no error in TABLE 1 (i.e., '0001111'), the one-hot code generation element 212 may enable the fifth bit OHC<4> of the one-hot code OHC<7:0>.

The magnitude grouping element 214 may generate the first to fifth magnitude signals MG0 to MG4 by grouping the bits of the one-hot code OHC<7:0>, which is symmetrical based on the fifth bit OHC<4> of the one-hot code OHC<7:0> (which is the no-error signal NO_ERROR). For example, the magnitude grouping element 214 may output the fifth bit OHC<4> of the one-hot code OHC<7:0> (which is the no-error signal NO_ERROR) as the first magnitude signal MG0. The magnitude grouping element 214 may output a signal obtained by grouping the fourth bit OHC<3> and the sixth bit OHC<5> of the one-hot code OHC<7:0> as the second magnitude signal MG1. The magnitude grouping element 214 may output a signal obtained by grouping the third bit OHC<2> and the seventh bit OHC<6> of the one-hot code OHC<7:0> as the third magnitude signal MG2.

The magnitude grouping element 214 may output a signal obtained by grouping the second bit OHC<1> and the eighth bit OHC<7> of the one-hot code OHC<7:0> as the fourth magnitude signal MG3. The magnitude grouping element 214 may output the first bit OHC<0> of the one-hot code OHC<7:0> as the fifth magnitude signal MG4.

The counting element 220 may perform a counting operation at a predetermined cycle and output the counting signal CNT<3:0> having time information. Also, to prevent the output voltage VOUT from not varying substantially within a predetermined range (which is a sticking error), the counting element 220 may generate a stick pulse signal STICK_PULSE by checking a particular signal among the first to fifth magnitude signals MG0 to MG4 at a predetermined cycle. For example, the counting element 220 may generate the stick pulse signal STICK_PULSE by checking the no-error signal NO_ERROR among the first to fifth magnitude signals MG0 to MG4, whenever the counting signal CNT<3:0> reaches a full count.

The counting element 220 may include a counter 222 and a stick pulse generator 224.

The counter 222 may generate the 4-bit counting signal CNT<3:0> by performing a counting operation in response to a cycle oscillation signal OSC. When the 4-bit counting signal CNT<3:0> reaches a full count (which is '1111'), the counter 222 may generate a counting end signal TIME_OUT. The stick pulse generator 224 may generate a stick pulse signal STICK_PULSE when the counting end signal TIME_OUT is enabled and the no-error signal NO_ERROR is disabled.

The integral control signal generation element 230 may output the first to fifth integral control signals MPULSE<4:0> which respectively correspond to the first to fifth magnitude signals MG0 to MG4 in response to the stick pulse signal STICK_PULSE. Herein, the first integral control signal MPULSE<0> is a signal that is enabled when an error is '0' (in case of no error), and the first integral control signal MPULSE<0> is not inputted into the integral control unit 150 (see FIG. 4).

The integral control signal generation element 230 may include first to fifth pulse generation elements 230_1 to 230_5 which respectively correspond to the first to fifth magnitude signals MG0 to MG4. The first to fifth pulse generation elements 230_1 to 230_5 may generate the first to fifth integral control signals MPULSE<4:0>, which are pulse signals, when the first to fifth magnitude signals MG0 to MG4, which are level signals, are enabled. Herein, when the stick pulse signal STICK_PULSE is enabled, the second to fifth pulse generation elements 230_2 to 230_5 may generate the second to fifth integral control signals MPULSE<4:1> based on a signal that is enabled right before among the second to fifth magnitude signals MG0 to MG4.

When even one signal among the first to fifth integral control signals MPULSE<4:0> is enabled, the proportional control signal generation element 240 may generate the proportional control signal PPULSE.

Meanwhile, although not illustrated in the drawing, the counter 222 may be reset in response to a signal (not shown) that is generated by delaying the proportional control signal PPULSE by a predetermined time. For example, the predetermined time may correspond to a time for the integral control unit 150 receiving the counting signal CNT<3:0> and securing a shifting operation margin. In short, the counter 222 may be reset after even one signal among the first to fifth integral control signals MPULSE<4:0> is enabled and the integral control unit 150 may perform a shifting operation based on the counting signal CNT<3:0>.

As described above, the control signal generation unit 130 may enable the proportional control signal PPULSE whenever there is a change in the error code LV<6:0>, and enable one signal among the second to fifth integral control signals MPULSE<4:1>, which is corresponding to the magnitude of the change in the error code LV<6:0>. Also, the control signal generation unit 130 may output the middle bit (which is the fourth bit LV<3>) of the error code LV<6:0> as the error sign signal SIGN, and output the counting signal CNT<3:0> at a uniform cycle to provide time information.

Figure 7:
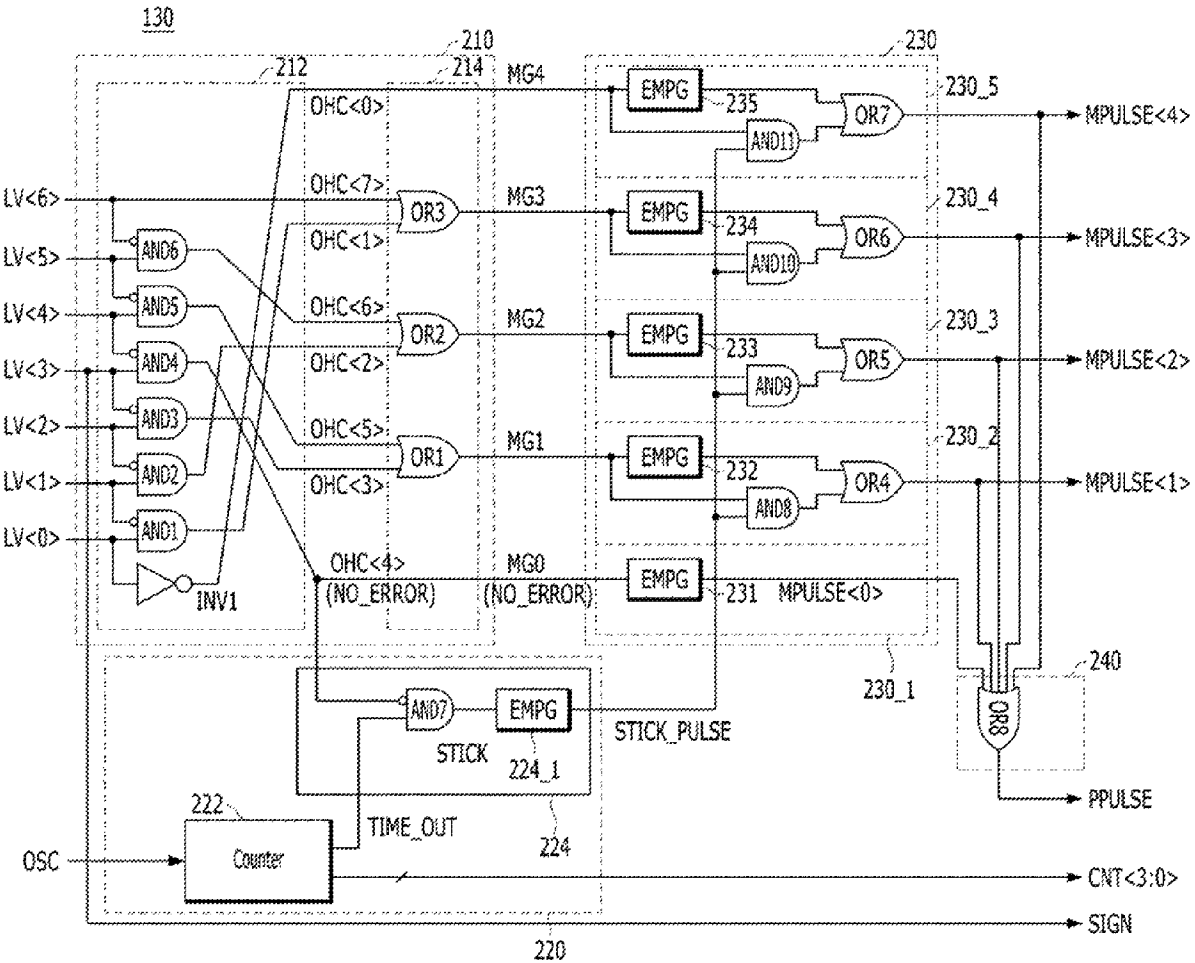
FIG. 7 is a circuit diagram illustrating the structure of the control signal generation unit shown in FIG. 6 in detail.

FIG. 7 is a circuit diagram illustrating the structure of the control signal generation unit 130 shown in FIG. 6 in detail.

Referring to FIG. 7, the one-hot code generation element 212 may include first to sixth AND gates AND1 to AND6 and a first inverter INV1. The first to sixth AND gates AND1 to AND6 may perform an AND operation onto the bits of the error code LV<6:0> and an inverted signal of a neighboring bit and output the second to seven bits of the one-hot code OHC<7:0>. The first inverter INV1 may invert the first bit LV<0> of the error code LV<6:0> and output the first bit OHC<0> of the one-hot code OHC<7:0>. Also, the one-hot code generation element 212 may output the seventh bit LV<6> of the error code LV<6:0> as the eighth bit OHC<7> of the one-hot code OHC<7:0>.

The magnitude grouping element 214 may include a first OR gate OR1, a second OR gate OR2 and a third OR gate OR3. The first OR gate OR1 performs an OR operation on the fourth bit OHC<3> and the sixth bit OHC<5> of the one-hot code OHC<7:0> and outputs the second magnitude signal MG1. The second OR gate OR2 performs an OR operation on the third bit OHC<2> and the seventh bit OHC<6> of the one-hot code OHC<7:0> and outputs the third magnitude signal MG2. The third OR gate OR3 performs an OR operation on the second bit OHC<I> and the eighth bit OHC<7> of the one-hot code OHC<7:0> and outputs the fourth magnitude signal MG3. Also, the magnitude grouping element 214 may output the fifth bit OHC<4> of the one-hot code OHC<7:0> (which is the no-error signal NO_ERROR) as it is as the first magnitude signal MG0.

Therefore, the error calculation element 210 including the one-hot code generation element 212 and the magnitude grouping element 214 may receive the 7-bit error code LV<6:0> as shown in the following TABLE 2, calculate magnitudes of the 7-bit error code LV<6:0> to output the first to fifth magnitude signals MG0 to MG4, and perform a sign operation for the 7-bit error code LV<6:0> to output the error sign signal SIGN.

TABLE 2

| LV<6:0> | OHC<7:0> | MG0 | MG1 | MG2 | MG3 | MG4 | SIGN |
|---|---|---|---|---|---|---|---|
| 0000000 | 00000001 | 0 | 0 | 0 | 0 | 1 | 0 |
| 0000001 | 00000010 | 0 | 0 | 0 | 1 | 0 | 0 |
| 0000011 | 00000100 | 0 | 0 | 1 | 0 | 0 | 0 |
| 0000111 | 00001000 | 0 | 1 | 0 | 0 | 0 | 0 |
| 0001111 | 00010000 | 1 | 0 | 0 | 0 | 0 | 1 |
| 0011111 | 00100000 | 0 | 1 | 0 | 0 | 0 | 1 |
| 0111111 | 01000000 | 0 | 0 | 1 | 0 | 0 | 1 |
| 1111111 | 10000000 | 0 | 0 | 0 | 1 | 0 | 1 |

The stick pulse generator 224 of the counting element 220 may include a seventh AND gate AND7 and a first error magnitude pulse generator (EMPG) 224_1. The seventh AND gate AND7 may perform an AND operation onto the counting end signal TIME_OUT and an inverted signal of the no-error signal NO_ERROR and generate a stick signal STICK. The first error magnitude pulse generator (EMPG) 224_1 may receive the stick signal STICK, which is a level signal, and generate the stick pulse signal STICK_PULSE, which is a pulse signal that pulses for a predetermined period.

The first to fifth pulse generation elements 230_1 to 230_5 of the integral control signal generation element 230 may include second to sixth error magnitude pulse generators (EMPG) 231 to 235.

The first pulse generation element 230_1 may include the second error magnitude pulse generator (EMPG) 231, and generate the first integral control signal MPULSE<0>, which is a pulse signal corresponding to the first magnitude signal MG0. Consequently, when the error code LV<6:0> is '0001111', in other words, when it is determined that the output voltage VOUT reaches the ideal target voltage level and there is no substantial change, the first pulse generation element 230_1 may enable the first integral control signal MPULSE<0>.

The second to fifth pulse generation elements 230_2 to 230_5 may include third to sixth error magnitude pulse generators (EMPG) 231 to 235, eighth to $11^{th}$ AND gates ANDS to AND11, and fourth to seventh OR gates OR4 to OR7, respectively. Therefore, in response to the second to fifth magnitude signals MG1 to MG4, which are level signals, the second to fifth pulse generation elements 230_2 to 230_5 may generate the second to fifth integral control signals MPULSE<4:1>, which are pulse signals, respectively. When the stick pulse signal STICK_PULSE is enabled, the second to fifth pulse generation elements 230_2 to 230_5 may generate the second to fifth integral control signals MPULSE<4:1> according to the respective second to fifth magnitude signals MG1 to MG4.

The proportional control signal generation element 240 may include an eighth OR gate OR8 that may perform an OR operation onto the first to fifth integral control signals MPULSE<4:0> and output the proportional control signal PPULSE.

Figure 8:
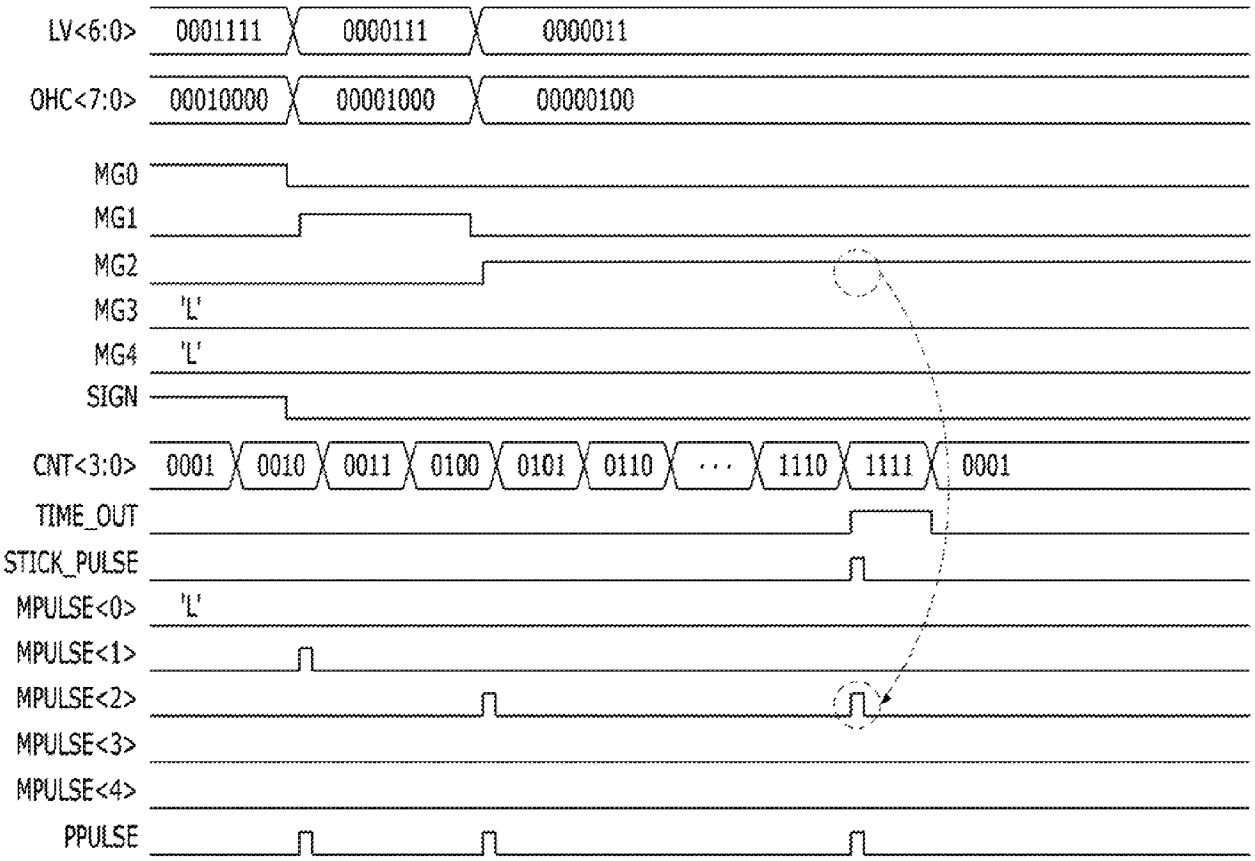
FIG. 8 is a timing diagram illustrating an operation of the control signal generation unit shown in FIGS. 6 and 7.

FIG. 8 is a timing diagram illustrating an operation of the control signal generation unit 130 shown in FIGS. 6 and 7. Referring to FIG. 8, a case where an undershoot occurs is shown when the output voltage VOUT is at the ideal target voltage level. Herein, the analog-to-digital converter 110 of FIG. 4 may detect an error component of the output voltage VOUT and output the error code LV<6:0> in the order from a no-error state to an undershoot state. That is, the error code LV<6:0> are in the order of '0001111', which is a no-error state, to the →'0000111'→'0000011', which is an undershoot state.

First of all, when the error code LV<6:0> is changed from '0001111', which is a no-error state, to the '0000111', the one-hot code generation element 212 may generate an one-hot code OHC<7:0> with '00001000' because there is an inflection point between the third bit LV<2> and the fourth bit LV<3> of the error code LV<6:0>. The magnitude grouping element 214 may enable the second magnitude signal MG1, as the fourth bit OHC<3> of the one-hot code OHC<7:0>. Accordingly, the second pulse generation element 230_2 may enable the second integral control signal MPULSE<1> according to the enabled second magnitude signal MG1. Herein, the one-hot code generation element 212 may output the error sign signal SIGN at a logic low level based on the fourth bit LV<3> of the error code LV<6:0>.

Also, when the error code LV<6:0> is changed from '0000111' to '0000011', the one-hot code generation element 212 may generate an one-hot code OHC<7:0> with '00000100' because there is an inflection point between the second bit LV<1> and the third bit LV<2> of the error code LV<6:0>. The magnitude grouping element 214 may enable the third magnitude signal MG2, as the third bit OHC<2> of the one-hot code OHC<7:0>. Accordingly, the third pulse generation element 230_3 may enable the third integral control signal MPULSE<2> according to the enabled third magnitude signal MG2.

The counter 222 may generate the 4-bit counting signal CNT<3:0>, and when the 4-bit counting signal CNT<3:0> reaches '1111', the counter 222 may generate the counting end signal TIME_OUT. The stick pulse generator 224 may enable the stick pulse signal STICK_PULSE, while the counting end signal TIME_OUT is enabled and the no-error signal NO_ERROR is disabled.

When the stick pulse signal STICK_PULSE is enabled, the third pulse generation element 230_3 may enable the third integral control signal MPULSE<2> according to the enabled third magnitude signal MG2. Therefore, it is possible to prevent a case where the output voltage VOUT is not substantially changed within a particular range (which is a sticking error) by checking the no-error signal NO_ERROR at every predetermined cycle and enabling once again the integral control signal that is enabled right before.

Figure 9:
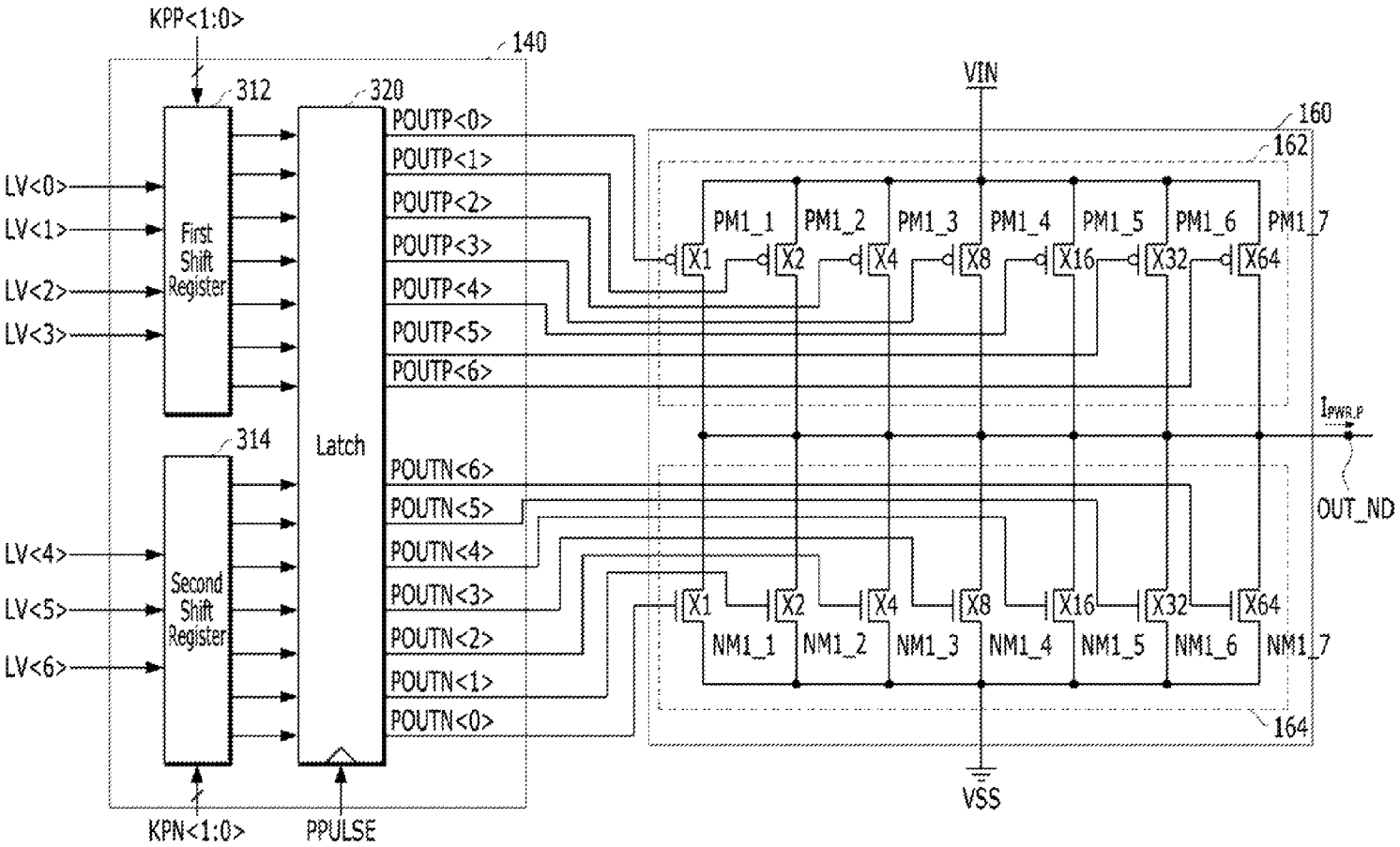
FIG. 9 is a block diagram illustrating structures of a proportional control unit and a first array driver shown in FIG. 4.

FIG. 9 is a block diagram illustrating exemplary structures of the proportional control unit 140 and the first array driver 160 shown in FIG. 4.

Referring to FIG. 9, the proportional control unit 140 may include a first shift register 312, a second shift register 314, and a latch 320.

The first shift register 312 may shift the lower bit group LV<3:0> of the error code LV<6:0> based on the first proportional gain factor KPP<1:0>. The second shift register 314 may shift the upper bit group LV<6:4> of the error code LV<6:0> based on the second proportional gain factor KPN<1:0>. The latch 320 may output the output of the first shift register 312 as the pull-up control signal POUTP<6:0> and output the output of the second shift register 314 as the pull-down control signal POUTP<6:0> in response to the proportional control signal PPULSE. According to an embodiment, the latch 320 may be implemented with a plurality of D-flipflops that receives the proportional control signal PPULSE as a clock.

The pull-up array unit 162 of the first array driver 160 may include first to seventh pull-up transistors PM1_1 to PM1_7 that are coupled in parallel between the power source voltage terminal VIN and the output node OUT_ND, and receive the bits of the pull-up control signal POUTP<6:0> through gates of the first to seventh pull-up transistors PM1_1 to PM1_7. Therefore, the pull-up array unit 162 may control the number of the first to seventh pull-up transistors PM1_1 to PM1_7 that are turned on in response to the pull-up control signal POUTP<6:0>. According to an embodiment, the first to seventh pull-up transistors PM1_1 to PM1_7 may be implemented by PMOS transistors.

The pull-down array unit 164 of the first array driver 160 may include first to seventh pull-down transistors NM1_1 to NM1_7 that are coupled in parallel between the output node OUT_ND and a ground voltage terminal VSS, and receive the bits of the pull-down control signal POUTN<6:0> through gates of the first to seventh pull-down transistors NM1_1 to NM1_7. Therefore, the pull-down array unit 164 may control the number of the first to seventh pull-down transistors NM1_1 to NM1_7 that are turned on in response to the pull-down control signal POUTN<6:0>. According to an embodiment, the first to seventh pull-down transistors NM1_1 to NM1_7 may be implemented by NMOS transistors.

The first to seventh pull-up transistors PM1_1 to PMI1_7 may be formed to have a size that is increased two times. For example, the seventh pull-up transistor PM1_7 which receives the seventh bit POUTP<6> of the pull-up control signal POUTP<6:0> may be formed to have a size $2^6$ ($2^6$=64) times as big as the size of the first pull-up transistor PM1_1 which receives the first bit POUTP<0> of the pull-up control signal POUTP<6:0>. Likewise, the first to seventh pull-down transistors NM1_1 to NM1_7 may be formed to have a size (W/L: width/length) which increases by two times. In short, it is possible to control the magnitude of current according to the first proportional gain factor KPP<1:0> and the second proportional gain factor KPN<1:0> to increase non-linearly by forming the first to seventh pull-up transistors PM1_1 to PM1_7 or the first to seventh pull-down transistors NM1_1 to NM1_7 to have a size that increases by a predetermined number of times. Therefore, the first array driver 160 may control the amount of the first current $I_{PWR_P}$ to increase as the error component of the output voltage VOUT is increased.

As described above, the proportional control unit 140 may synchronize a result obtained by multiplying the error code LV<6:0> by the first and second proportional gain factors KPP<1:0> and KPN<1:0> with the proportional control signal PPULSE, and output the pull-up control signal POUTP<6:0> and the pull-down control signal POUTN<6:0>. Also, the first array driver 160 may include the pull-up array unit 162 that is implemented with PMOS transistors and the pull-down array unit 164 that is implemented with NMOS transistors. Therefore, the proportional control unit 140 may maintain the output voltage VOUT uniformly by increasing the first current $I_{PWR_P}$ by using the pull-up array unit 162 when undershoot occurs in the output voltage VOUT, and decreasing the first current $I_{PWR_P}$ by using the pull-down array unit 164 when overshoot occurs in the output voltage VOUT.

Figure 10:
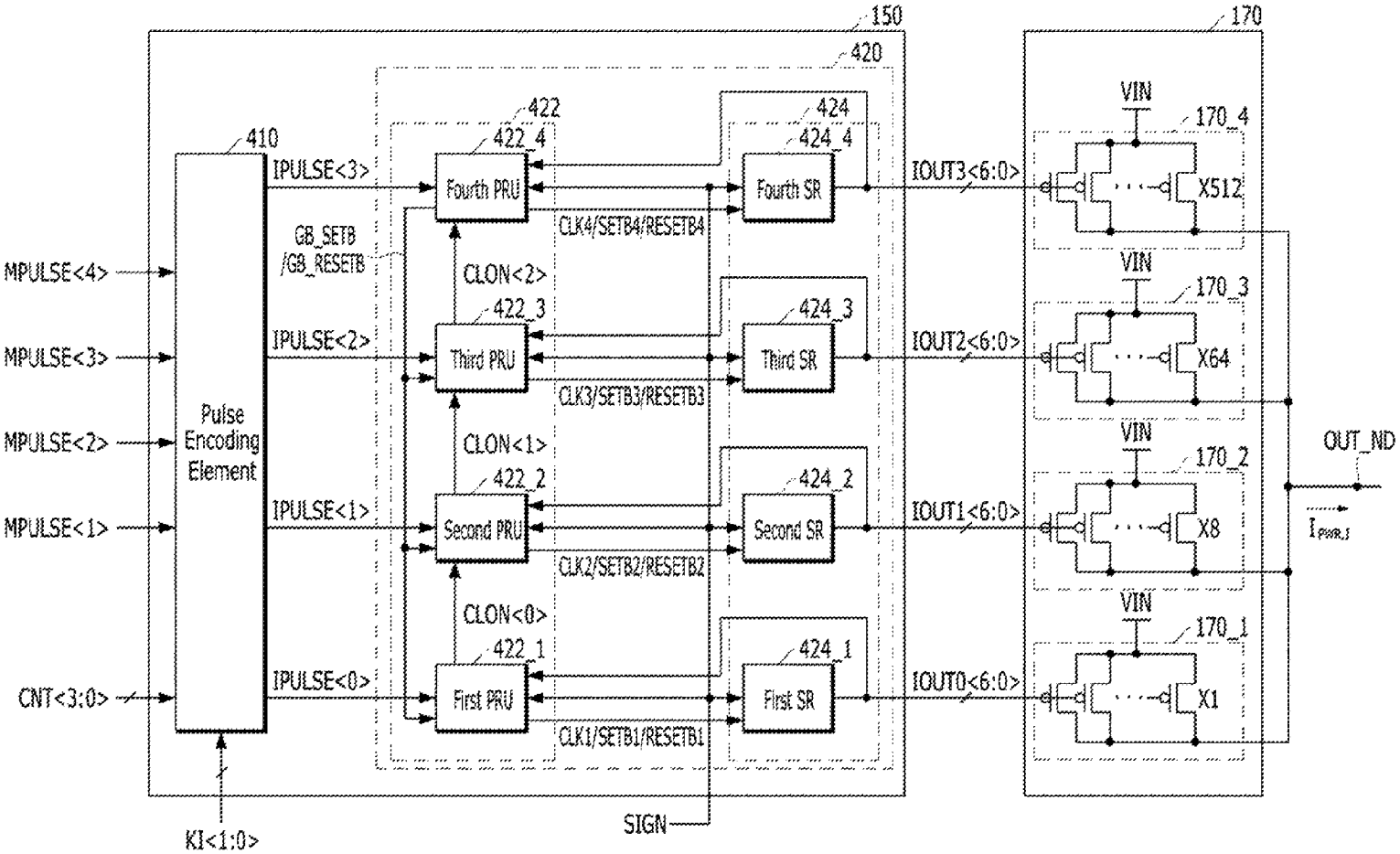
FIG. 10 is a block diagram illustrating structures of an integral controller and a second array driver shown in FIG. 4.

FIG. 10 is a block diagram illustrating exemplary structures of the integral control unit 150 and the second array driver 170 shown in FIG. 4.

Referring to FIG. 10, the integral control unit 150 may include a pulse encoding element 410 and a code output element 420.

The pulse encoding element 410 may generate first to fourth integral pulse signals IPULSE<3:0> by primarily shifting the second to fifth integral control signals MPULSE<4:1> to perform an integral operation and secondarily shifting a shifted signal based on the integral gain factor KI<1:0> to perform a multiplication operation.

The code output element 420 may control pre-stored code values based on the first to fourth integral pulse signals IPULSE<3:0> and the error sign signal SIGN and output the first to fourth sub-pull-up control signals IOUT0<6:0> to IOUT3<6:0>. Herein, the pre-stored code values may be a value of a 7-bit thermometer code.

The code output element 420 may include a pulse routing group 422 and a shift register group 424.

The pulse routing group 422 may include first to fourth pulse routing elements PRU 422_1 to 422_4 that receive the first to fourth integral pulse signals IPULSE<3:0>, respectively. The shift register group 424 may include first to fourth shift register elements SR 424_1 and 424_4 that respectively output the first to fourth sub-pull-up control signals IOUT0<6:0> to IOUT3<6:0> corresponding to the first to fourth pulse routing elements PRU 422_1 to 422_4.

The first to fourth pulse routing elements PRU 422_1 to 422_4 may route clock signals CLK1 to CLK4 to the first to fourth shift register elements SR 424_1 and 424_4 based on the first to fourth integral pulse signals IPULSE<3:0>. Also, when overflow/underflow of the first to fourth shift register elements SR 424_1 and 424_4 is detected based on the first to fourth sub-pull-up control signals IOUT0<6:0> to IOUT3<6:0> outputted from the first and fourth shift register elements SR 424_1 and 424_4 and the error sign signal SIGN, the first to fourth pulse routing elements PRU 422_1 to 422_4 may route set/reset signals SETB1/RESETB1 to SETB4/RESETB4 to the first to fourth shift register elements SR 424_1 and 424_4, respectively. Herein, when underflow of an assigned shift register element is detected, the first to fourth pulse routing elements PRU 422_1 to 422_4 may route the set signals SETB1 to SETB4 to the assigned shift register elements. When overflow of the assigned shift register element is detected, the first to fourth pulse routing elements PRU 422_1 to 422_4 may route the reset signals RESETB1 to RESETB4 to the assigned shift register elements.

The first to fourth shift register elements SR 424_1 and 424_4 may control the shifting direction based on the error sign signal SIGN, while shifting the pre-stored code values according to the inputted clock signals CLK1 to CLK4 and outputting the first to fourth integral pulse signals IPULSE<3:0>. For example, when the error sign signal SIGN is in a logic low level (i.e., an undershoot state), the first to fourth shift register elements SR 424_1 and 424_4 may shift the stored code value toward the right side (i.e., the least significant bit (LSB) direction). In contrast, when the error sign signal SIGN is in a logic high level (i.e., an overshoot state), the first to fourth shift register elements SR 424_1 and 424_4 may shift the stored code value toward the left side (i.e., the most significant bit (MSB) direction). Also, the first to fourth shift register elements SR 424_1 and 424_4 may set/reset the pre-stored code value based on the inputted set/reset signals SETB1/RESETB1 to SETB4/RESETB4.

Meanwhile, when overflow/underflow of the first to third shift register elements SR 424_1 to 424_3 is detected, the lower pulse routing elements PRU, which are the first to third pulse routing elements PRU 422_1 to 422_3, except the uppermost pulse routing element PRU which is the fourth pulse routing element PRU 422_4, may route the first to third integral pulse signals IPULSE<2:0> as first to third clone signals CLON<2:0> to the upper pulse routing elements PRU (which are the second to fourth pulse routing elements PRU 422_2 to 422_4). For example, the upper pulse routing elements PRU (which are the second to fourth pulse routing elements PRU 422_2 to 422_4) may receive the first to third clone signals CLON<2:0> that are transferred from the lower pulse routing elements PRU, which are the first to third pulse routing elements PRU 422_1 to 422_3, or the second to fourth integral pulse signals IPULSE<3:1> as input signals. Also, the set/reset signal SETB4/RESETB4 outputted from the uppermost pulse routing elements PRU (i.e., the fourth pulse routing element PRU 422_4) may be inputted into the first to third pulse routing elements PRU 422_1 to 422_3 as global set/reset signals GB_SETB/GB_RESETB that represent the maximal overflow/underflow of the entire pulse routing elements PRU 422_1 to 422_4. When the global set/reset signals GB_SETB/GB_RESETB are enabled in a logic low level, the first to fourth pulse routing elements PRU 422_1 to 422_4 may enable all the set/reset signals SETB1/RESETB1 to SETB4/RESETB4 in a logic low level and output them. The first to fourth shift register elements SR 424_1 and 424_4 may set/reset the pre-stored code value based on the set/reset signals SETB1/RESETB1 to SETB4/RESETB4.

The second array driver 170 may include first to fourth sub-pull-up arrays 170_1 to 170_4 that respectively correspond to the first to fourth sub-pull-up control signals IOUT0<6:0> to IOUT3<6:0>.

The first to fourth sub-pull-up arrays 170_1 to 170_4 may include first to seventh pull-up transistors that are coupled in parallel between the power source voltage terminal VIN and the output node OUT_ND, and receive the bits of the assigned signal among the first to fourth sub-pull-up control signals IOUT0<6:0> to IOUT3<6:0> through gates of the first to seventh pull-up transistors. Therefore, the first to fourth sub-pull-up arrays 170_1 to 170_4 may control the number of the pull-up transistors that are turned on in response to the assigned signal among the first to fourth sub-pull-up control signals IOUT0<6:0> to IOUT3<6:0>. In some embodiments, the first to seventh pull-up transistors may be implemented with PMOS transistors.

The first to seventh pull-up transistors included in the same sub-pull-up array may have the same size (W/L). The first to seventh pull-up transistors included in each of the first to fourth sub-pull-up arrays 170_1 to 170_4 may be formed to have a size (W/L) that is increased by a predetermined ratio (e.g., eight times) as it goes to the upper sub-pull-up arrays. For example, the first to seventh pull-up transistors included in the fourth sub-pull-up array 170_4 may have the same size, and the first to seventh pull-up transistors included in the fourth sub-pull-up array 170_4 may be formed to have a size 512 times as big as the first to seventh pull-up transistors included in the first sub-pull-up array 170_1. Therefore, the second array driver 170 may control the magnitude of the second current $I_{PWR.I}$ to be non-linearly increased, as it goes from the first sub-pull-up array 170_1 to the fourth sub-pull-up array 170_4. Therefore, the second array driver 170 may control the magnitude of the second current $I_{PWR.I}$ to be increased as the error component of the output voltage VOUT is increased.

As described above, the integral control unit 150 may control the pre-stored code value based on the error sign signal SIGN and the shifting result that is generated by primarily shifting the second to fifth integral control signals MPULSE<4:1> according to the counting signal CNT<3:0> representing time information and secondarily shifting the shifted signal according to the integral gain factor KI<1:0>, and output the first to fourth sub-pull-up control signals IOUT0<6:0> to IOUT3<6:0>. Whereas a typical digital LDO regulator is formed of a generic multiplier and an adder and has a long control loop latency, the integral control unit 150 of the digital LDO regulator in accordance with the embodiment of the present invention may decrease the control loop latency by performing at least two multi-shifting operations and generating the integral control signal.

As described above, the event-driven digital LDO regulator 100 may implement the proportional control unit 140 and the integral control unit 150 in a parallel scheme by separately including the first array driver 160 for proportional control and the second array driver 170 for integral control. In other words, the control loop latency may be reduced and the regulation performance may be improved by adding the first current $I_{PWR.P}$ which is obtained by controlling the first array driver 160 and the second current $I_{PWR.I}$ which is obtained by controlling the second array driver 170 in the form of current in a current domain and removing the existing adder. Also, the integral control unit 150 of the event-driven digital LDO regulator 100 in accordance with an embodiment of the present invention may compensate for the undershoot and overshoot of the output voltage VOUT, using the first array driver 160 for proportional control, which comprises both the pull-up array unit 162 for compensating for the undershoot of the output voltage VOUT and the pull-down array unit 164 for compensating for the overshoot of the output voltage VOUT.

According to an embodiment of the present invention, a digital LDO regulator may be able to decrease a control loop latency by implementing a proportional controller P and an integral controller I in parallel, which leads to improved regulation performance.

Also, according to an embodiment of the present invention, an array driver for proportional control of the digital LDO regulator may include both a pull-up array unit for compensating for an undershoot of an output voltage and a pull-down array unit for compensating for an overshoot of the output voltage. Thus, it is possible to compensate for the undershoot and overshoot of the output voltage.

While the present invention has been described with respect to specific embodiments, it will be apparent to those skilled in the art that various changes and modifications may be made without departing from the spirit and scope of the invention as defined in the following claims.

For example, the logic gates and transistors described in the above embodiments of the present invention may have different positions and kinds according to the polarity of an inputted signal.

What is claimed is:

1. A regulator comprising:

an analog-to-digital converting unit suitable for detecting a change in an output voltage from an output node and outputting an error code based on the detected result;

a digital processing unit suitable for generating a proportional control signal, a plurality of integral control signals, a counting signal, and an error sign signal based on the error code, outputting pull-up and pull-down control signals by multiplying the error code by a proportional gain factor in response to the proportional control signal, and outputting a plurality of sub-pull-up control signals by performing integration on the integral control signals based on the counting signal and multiplying the integration result by an integral gain factor;

a first driving unit suitable for outputting a first current in response to the pull-up and pull-down control signals to the output node; and a second driving unit suitable for outputting a second current in response to the sub-pull-up control signals to the output node.

2. The regulator of claim 1, wherein the error code includes a unary code.

3. The regulator of claim 1, wherein the digital processing unit enables the proportional control signal whenever there is a change in the error code, enables one signal corresponding to a magnitude of the change in the error code among the integral control signals, and outputs information indicating whether the change in the error code is overshoot or undershoot.

4. The regulator of claim 1, wherein the digital processing unit outputs the pull-up control signal by multiplying a first bit group of the error code by the proportional gain factor and synchronizing the multiplying result with the proportional control signal, and outputs the pull-down control signal by multiplying a second bit group of the error code by the proportional gain factor and synchronizing the multiplying result with the proportional control signal.

5. The regulator of claim 1, wherein the first driving unit includes:

a pull-up array unit including a plurality of pull-up transistors coupled in parallel between a power source voltage terminal and the output node; and a pull-down array unit including a plurality of pull-down transistors coupled in parallel between the output node and a ground voltage terminal, wherein the number of turned-on pull-up transistors is controlled in response to the pull-up control signal, and wherein the number of turned-on pull-down transistors is controlled in response to the pull-down control signal.

6. The regulator of claim 1, wherein the second driving unit includes:

a plurality of sub-pull-up array units respectively corresponding to the sub-pull-up control signals, wherein each of the sub-pull-up array units includes a plurality of pull-up transistors coupled in parallel between a power source voltage terminal and the output node, and the number of turned-on pull-up transistors is controlled in response to an assigned signal among the sub-pull-up control signals.

7. A regulator comprising:

an analog-to-digital converting unit suitable for detecting a change in an output voltage from an output node and outputting an error code based on the detected result;

a control signal generation unit suitable for generating a proportional control signal, a plurality of integral control signals, and a counting signal, and an error sign signal based on the error code;

a proportional control unit suitable for shifting the error code based on a proportional gain factor, and outputting a first control signal by synchronizing the shifted error code with the proportional control signal;

a first driving unit suitable for outputting a first current in response to the first control signal to the output node;

an integral control unit suitable for shifting the integral control signals based on the counting signal and an integral gain factor at least two times, and outputting shifted results as a plurality of second control signals based on the error sign signal; and a second driving unit suitable for outputting a second current in response to the second control signals to the output node.

8. The regulator of claim 7, wherein the error code includes a thermometer code formed of a unary code.

9. The regulator of claim 7, wherein the control signal generation unit enables the proportional control signal whenever there is a change in the error code, enables one signal corresponding to a magnitude of the change in the error code among the integral control signals, and outputs information representing whether the change in the error code is overshoot or undershoot.

10. The regulator of claim 7, wherein the control signal generation unit includes:

an error calculation element suitable for generating a plurality of magnitude signals by performing a magnitude calculation on the error code, and outputting a middle bit of the error code as the error sign signal;

a counting element suitable for outputting the counting signal having time information by performing a counting operation at a predetermined cycle, and generating a stick pulse signal by checking the magnitude signals whenever the counting signal is outputted;

an integral control signal generation element suitable for generating the integral control signals corresponding to the magnitude signals based on the stick pulse signal; and a proportional control signal generation element suitable for generating the proportional control signal when any of the integral control signals is enabled.

11. The regulator of claim 10, wherein the error calculation element includes:

an one-hot code generation element suitable for detecting an inflection point where a logic level is changed by scanning the error code from a least significant bit (LSB) toward a most significant bit (MSB) and generating a multi-bit one-hot code; and a magnitude grouping element suitable for generating the magnitude signals by grouping bits that are symmetrical based on a particular bit of the one-hot code.

12. The regulator of claim 11, wherein the counting element includes:

a counter suitable for generating the counting signal by performing a counting operation in response to a cycle oscillation signal and, when the counting signal reaches a full count, outputting a counting end signal; and a stick pulse generator suitable for generating the stick pulse signal when the counting end signal is enabled and the particular bit of the one-hot code is disabled.

13. The regulator of claim 10, wherein the integral control signal generation element includes:

a plurality of pulse generation elements suitable for generating the integral control signals that pulse for a predetermined period when the magnitude signals are enabled, and, when the stick pulse signal is enabled, generating the integral control signals based on a signal that is enabled right before among the magnitude signals.

14. The regulator of claim 7, wherein the proportional gain factor includes first and second proportional gain factors, and the first control signal includes pull-up and pull-down control signals, wherein the proportional control unit includes:

a first shift register suitable for shifting a first bit group of the error code based on the first proportional gain factor;

a second shift register suitable for shifting a second bit group of the error code based on the second proportional gain factor; and a latch suitable for synchronizing an output of the first shift register with the proportional control signal to output the pull-up control signal, and synchronizing an output of the second shift register with the proportional control signal to output the pull-down control signal.

15. The regulator of claim 7, wherein the first driving unit includes:

a pull-up array unit suitable for compensating for an undershoot of the output voltage in response to a pull-up control signal of the first control signal; and a pull-down array unit suitable for compensating for an overshoot of the output voltage in response to a pull-down control signal of the first control signal.

16. The regulator of claim 7, wherein the first driving unit includes:

a pull-up array unit including a plurality of pull-up transistors coupled in parallel between a power source voltage terminal and the output node; and a pull-down array unit including a plurality of pull-down transistors coupled in parallel between the output node and a ground voltage terminal, wherein the number of turned-on pull-up transistors is controlled in response to a pull-up control signal of the first control signal, and wherein the number of turned-on pull-down transistors is controlled in response to a pull-down control signal of the first control signal.

17. The regulator of claim 16, wherein the pull-up transistors have a size (W/L) which increases at a predetermined number of times, and the pull-down transistors have a size (W/L) which increases at a predetermined number of times.

18. The regulator of claim 7, wherein the integral control unit includes:

a pulse encoding element suitable for generating a plurality of integral pulse signals by primarily shifting the integral control signals based on the counting signal and secondarily shifting the shifted signals based on the integral gain factor; and a code output element suitable for outputting the second control signals by controlling a pre-stored code value based on the integral pulse signals and the error sign signal.

19. The regulator of claim 18, wherein the code output element includes:

a pulse routing group including a plurality of pulse routing elements which respectively receive the integral pulse signals; and a shift register group including a plurality of shift register elements which respectively output the second control signals corresponding to the pulse routing elements, wherein each of the pulse routing elements routes a clock signal to an assigned shift register element based on an assigned integral pulse signal, and routes a set/reset signal to the assigned shift register element when overflow/underflow of the assigned shift register element is detected based on the error sign signal, and wherein each of the shift register elements outputs assigned second control signal by shifting the pre-stored code value based on the clock signal, and sets/resets the pre-stored code value based on the set/reset signal.

20. The regulator of claim 7, wherein the second driving unit includes:

a plurality of sub-pull-up array units respectively corresponding to the second control signals, wherein each of the sub-pull-up array units includes a plurality of pull-up transistors coupled in parallel between a power source voltage terminal and the output node, and the number of turned-on pull-up transistors is controlled in response to an assigned signal among the second control signals.

21. The regulator of claim 20, wherein the pull-up transistors included in one sub-pull-up array unit have the same size (W/L), and the pull-up transistors included in each of the sub-pull-up arrays have a size (W/L) that is increased as a level of the corresponding sub-pull-up array unit becomes higher.

* * * * *